United States Patent [19]

Anderson et al.

[11] 4,254,586

[45] Mar. 10, 1981

[54] TIME CYCLE CONTROL SYSTEM FOR VIBRATORY FINISHING MACHINES

[75] Inventors: Gordon H. Anderson; David R. Nelson, both of Albert Lea; Richard T. Fetterly, Faribault, all of Minn.

[73] Assignee: King-Seeley Thermos Co., Prospect Heights, Ill.

[21] Appl. No.: 25,325

[22] Filed: Mar. 30, 1979

[51] Int. Cl.[3] ..... B24B 31/06

[52] U.S. Cl. ..... 51/163.1

[58] Field of Search ..... 51/163.1, 163.2, 7, 51/164.1, 263

[56] References Cited

U.S. PATENT DOCUMENTS

| | | | |
|---|---|---|---|
| 2,414,038 | 1/1947 | Gossard | 51/424 |
| 2,819,569 | 1/1958 | Augenieux | 51/263 |
| 3,337,997 | 8/1967 | Rampe | 51/163.1 |
| 3,500,591 | 3/1970 | Gawrouski | 51/263 |
| 3,871,135 | 3/1975 | Anderson | 51/163.1 |

*Primary Examiner*—Harold D. Whitehead

*Attorney, Agent, or Firm*—Harness, Dickey & Pierce

[57] ABSTRACT

A method and apparatus for controlling the time cycle of a vibratory finishing machine by providing a workpiece finishing media transfer device for transferring finishing media from a suitable source thereof to inlet and outlet zones of the finishing chamber and providing a ratioing mechanism for selectively proportioning the media supplied from the source thereof to the first and second transfer means.

5 Claims, 6 Drawing Figures

Fig. 3.
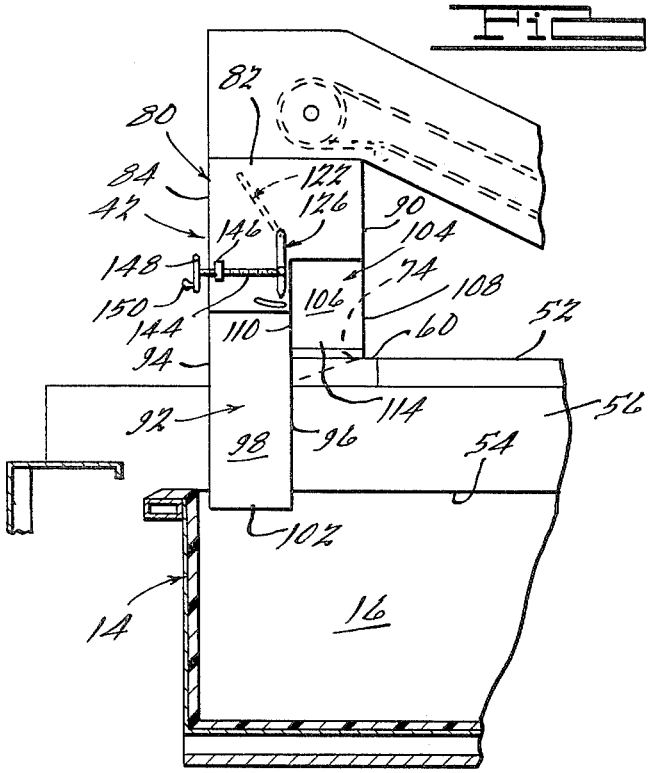
Fig. 4.
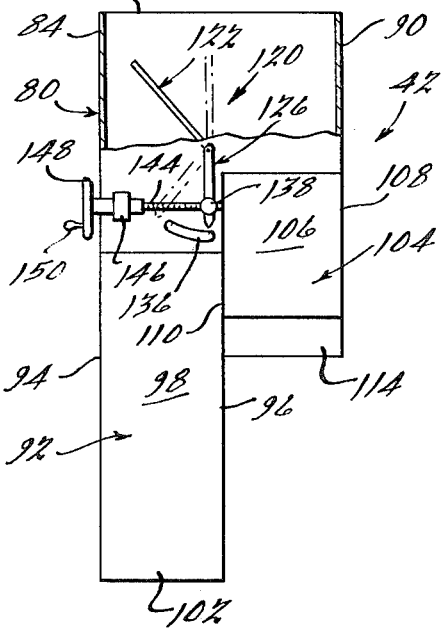
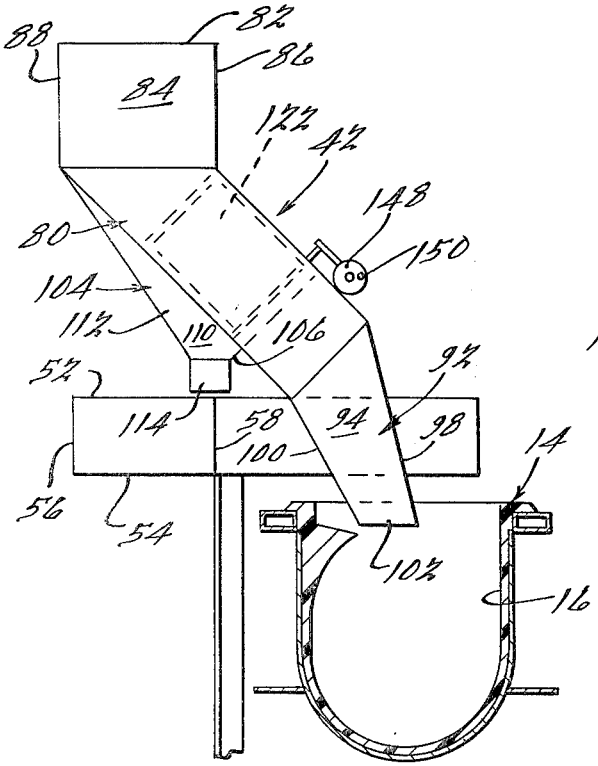
Fig. 5.
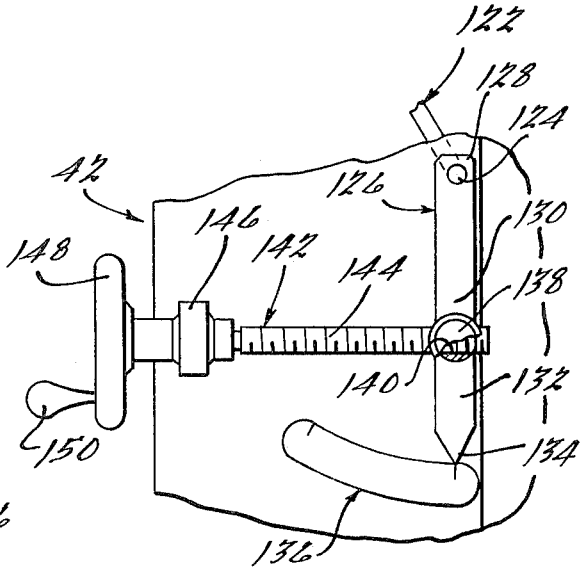
Fig. 6.

TIME CYCLE CONTROL SYSTEM FOR VIBRATORY FINISHING MACHINES

BACKGROUND AND SUMMARY OF THE INVENTION

The present invention is generally directed toward a new and improved apparatus for controlling the time cycle of vibratory finishing machines of the through-feed type wherein workpieces and finishing media are introduced at one end of an elongated vibratory tub or chamber and move longitudinally along the chamber during a finishing operation. When the media and workpieces reach the terminal or discharge end of the chamber, they are communicated to a separating apparatus wherein the media is separated from the workpieces and is recycled within the system by being communicated via a suitable conveyor belt to the inlet portion of the finishing chamber.

One particular problem of feed-through type vibratory finishing machines of the above-described type resides in the control of the time cycle during which workpieces are subjected to a finishing operation by the action of the finishing media within the finishing chambers. In particular, it has been found that when a long time cycle is desired, the discharge or outlet end or chute of the finishing chamber may be elevated slightly to resist the workpieces and media from traversing out the outlet end of the chamber; however, when this is done, the workpieces tend to hang up in the discharge chute due to the low media level at this point in the finishing chamber and additionally, there is a relatively small amount of finishing media available to be recycled via the return conveyor to the inlet portion of the finishing chamber. If it is desired to improve the discharge of the workpieces from the chamber, it has been necessary to lower the outlet end or discharge chute thereof and while this provides a relatively large amount of media for recycling via the return conveyor and greatly improved discharge characteristics, the time cycle for finishing the workpieces is reduced significantly and this can be highly objectionable in situations where a large time cycle is necessary in order to complete the finishing operation on the workpieces.

In accordance with the principles of the present invention, it has been found that a constant media flow can be maintained through the media return conveyor and the time cycle for the finishing operation can be varied in accordance with the desired time for finishing the workpieces by splitting or ratioing the media which is supplied from the return conveyor and transferring a first portion of such media to the inlet portion of the finishing chamber and a second portion of such media to a position adjacent the outlet or discharge end of the finishing chamber. As will hereinafter be described, by thus varying or proportioning the media supplied by the return conveyor between the inlet and outlet ends or zones of the finishing chamber, the desired time cycle can be achieved without varying the media level at the extreme discharge end or discharge chute of the finishing chamber which, in the past, has occurred and resulted in the workpieces being hung up within the chute when a long time cycle was desired.

It is accordingly, a general object of the present invention to provide a new and improved feed-through vibratory finishing machine.

It is a more particular object of the present invention to provide a new and improved time cycle control mechanism for feed-through type vibratory finishing machines.

It is yet a more particular object of the present invention to provide a new and improved vibratory finishing machine, as above described, which includes means for ratioing or proportioning the media supplied by the return conveyor between the inlet and outlet portions of the finishing chamber.

It is a more particular object of the present invention to provide a time cycle control mechanism, of the above character, which includes a proportioning gate or blade which may be manually adjusted to selectively ratio the media which is returned by the return conveyor between a first supply section which is communicable with the inlet portion or zone of the finishing chamber and a second supply section that is communicable with a secondary conveyor mechanism which communicates the media to a position adjacent the outlet end or zone of the finishing chamber.

It is still a further object of the present invention to provide a new and improved time cycle control device, of the above character, which is of a relatively simple design, is economical to manufacture and will have a long and effective operational life.

BRIEF DESCRIPTION OF THE DRAWINGS

FIG. 3 is an enlarged fragmentary side elevational view, partially broken away, of the time cycle control mechanism of the present invention, as shown in operative association with the inlet end or zone of the finishing chamber of the vibratory finishing machine shown in FIGS. 1 and 2;

FIG. 4 is a view similar to FIG. 3 and discloses a portion of the time cycle control device broken away for purposes of illustrating the proportioning blade or gate embodied therein;

FIG. 5 is an end elevational view of the structure shown in FIG. 3; and

FIG. 6 is an enlarged fragmentary side elevational view of the manual control mechanism of the time cycle control device of the present invention.

DESCRIPTION OF A PREFERRED EMBODIMENT

Figure 1:
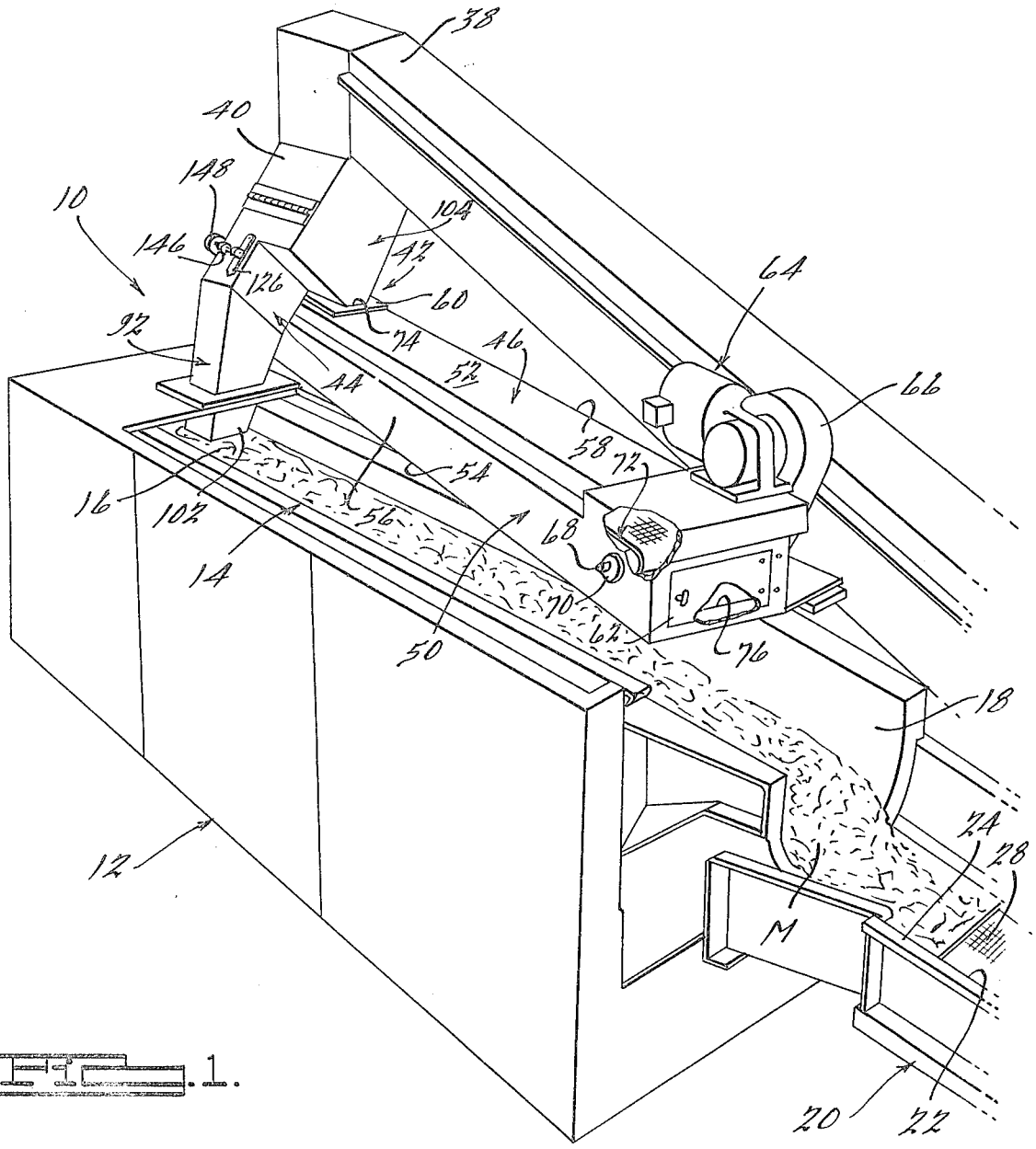
FIG. 1 is an elevated perspective view of a feed-through vibratory finishing machine having the new and time cycle control device of the present invention embodied therein.
Figure 2:
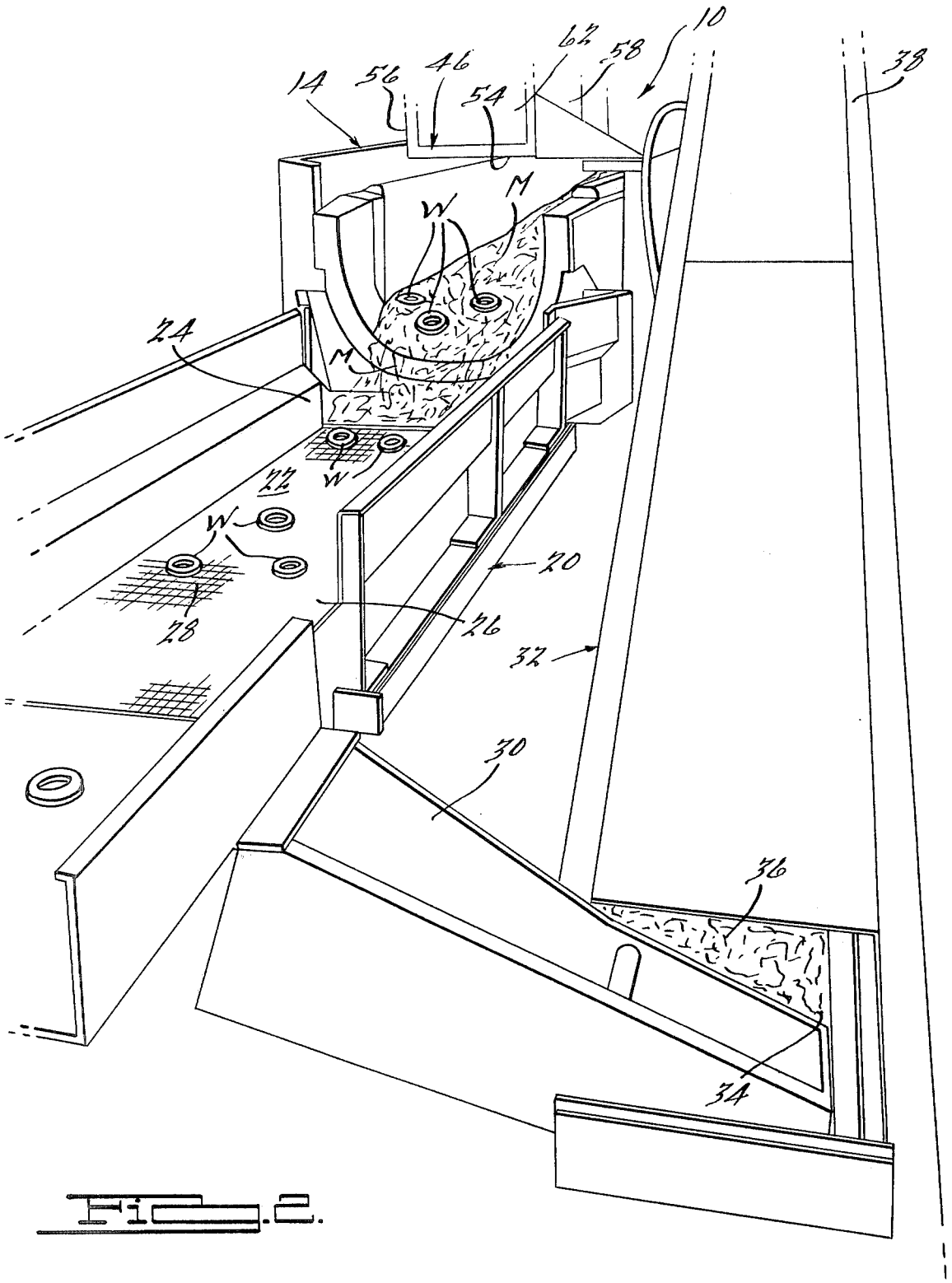
FIG. 2 is an elevated perspective view of the discharge end of the vibratory finishing machine illustrated in FIG. 1.

Referring now in detail to the drawings and in particular to FIG. 1 thereof, a vibratory finishing machine 10 is shown generally as comprising a support structure or base 12 which is adapted to support an elongated, longitudinally extending finishing chamber or tub 14. As will be appreciated by those skilled in the art, the finishing chamber 10 is of the feed-through type and is adapted to have a plurality of workpieces W and a quantity of finishing media M inserted at the inlet end or zone 16 of the tub 14. The workpieces W and media M are then subjected to vibratory movement due to energization of the machine 10, wherein the media M performs a finishing or deburring operation on the workpieces W. Finishing tub 14 includes an outlet end or zone 18 at the end thereof opposite the inlet end 16, with the outlet end 18 being communicable with a workpiece and media separating assembly, generally designated by the numeral 20. The separating assembly 20 includes a separating trough 22 having an inlet end 24 adapted to receive workpieces W and media M from the outlet end 18 of the finishing tub 14. The trough 22 also includes an outlet end 26 which is communicable with any suitable transport means or the like by which the workpieces W may be transmitted to some predetermined destination. As is well known in the art, the separating assembly 20 includes a perforated screen through which the media M may pass, resulting in the workpieces W being separated from the media M. The media M, thus separated from the workpieces is intended to be transferred via a suitable media chute 30 to a return conveyor assembly 32 which is provided with an endless conveyor belt 34 and has an inlet end 36 and an outlet end 38. As best seen in FIG. 2, the media M which is transferred to the conveyor assembly 32 via the chute 30 enters the assembly 32 via the inlet end 36 thereof and is transmitted upwardly to the outlet end 38 wherein the media is transferred to a dispensing chute 40, from where the media is distributed back to the finishing tub in a manner herinafter to be described.

In operation of the finishing machine 10, the plurality of workpieces W and media M are introduced into the finishing tub 14 at the inlet end 16 thereof and the machine 10 is properly energized so as to cause the tub 14 and contents thereof to vibrate. Typically, the vibratory motion of the tub 14 is in the form of an eliptical pattern about the longitudinal axis of the tub 14, in which case no particular motion of the parts toward the discharge or outlet end of the tub 14 occurs. Under these circumstances, the outlet end 18 of the tub 14 would be located lower than the inlet end 16 thereof, with the result that at the same time the finishing operation is being performed on the workpieces W, the workpieces W and media M move longitudinally toward the outlet end 18 during the vibratory movement of the tub 14. After the workpieces W and media M are transferred to the separating assembly 20, the media M drops downwardly through the interstices of the separating screen 28 and is then transferred back toward the inlet end or zone 16 of the tub 14 via the conveyor assembly 32, while the workpieces W are transferred to a suitable conveyor, pallet boxes or the like where the same may be conveniently transferred to some predetermined location.

As previously mentioned, one objectionable characteristic of feed-through type finishing machines of the above described type resides in the correlation of the cycle time for finishing the workpieces W and an efficient discharge of the workpieces and media from the outlet end 18 of the tub 14. In particular, if the outlet end 18 of the tub 14 is elevated in order to extend the cycle time, i.e., the time in which workpieces W traverse the length of the tub 14, the workpieces W will tend to hang up at the outlet end 18 due to a relatively low media level therein, and a disproportionately small amount of media is transferred via the chute 30 and conveyor assembly 32 back toward the inlet end 16 of the tub 14. Similarly, if the outlet end 18 of the tub 14 is lowered sufficiently to obtain the desired discharge of the workpieces W therefrom and to assure that a proper amount of media M is transferred back to the inlet end 16 for recycling, the finishing cycle time may be decreased to an extent wherein an incomplete finishing operation is performed on the workpieces W.

The aforesaid objectionable characteristics of typical feed-through vibratory type finishing machines is overcome through the principles of the present invention which provides a media proportioning or ratio assembly, generally designated by the numeral 42, that is intended to proportion or ratio the finishing media M being recycled by the conveyor assembly 32 to two different locations or zones along the length of the finishing tub 14. In particular, the media proportioning or ratio assembly 42 includes a media ratioing mechanism 44 which is communicable with the discharge chute 40 and receives finishing media M therefrom and distributes or ratios the same between the inlet zone 16 of the tub 14 and a secondary media conveyor assembly which is generally designated by the numeral 46 and extends generally horizontally between the mechanism 44 and a position adjacent the outlet zone 18 of the finishing tub 14. The conveyor assembly 46 includes an elongated, generally rectangular cross sectioned housing 50 having a top 52, bottom 54 and opposite sides 56, 58. The housing 50 also includes an inlet area 60 at the end thereof adjacent the inlet end 16 of the tub 14 and an access opening 62 at the end of the housing 50 opposite the inlet area 60.

Disposed at the opposite end of the housing 50 from the inlet area 60 is a suitable source of power, such as an electrically or hydraulically energized motor 64 having a gear reduction and drive mechanism 66 which functions to drivingly connect the power source 64 with a transversely extending drive shaft 68 that is journal supported at the opposite ends thereof, as seen at 70. The shaft 68 is adapted to impart driving movement to an endless conveyor belt 72 which is located interiorly of the housing 50 and which is intended to convey finishing media M supplied to the inlet opening 74 in the inlet are 60 thereof, to an outlet opening 76 formed in the bottom 54 of the end of the housing 50 adjacent the outlet zone 18 of the tub 14. As will hereinafter be described, a portion of the finishing media returned by the conveyor assembly 32 is transferred via the media proportioning assembly 42 to the inlet area 60 and in particular the inlet opening 74 of the conveyor assembly 46, which media is conveyed via the conveyor belt 72 to the outlet opening 76 wherein such media drops downwardly into the finishing tub 14 adjacent the outlet zone 18 thereof.

The media proportioning or ratioing mechanism 44 generally comprises an external housing or enclosure 80 that defines an inlet section 82 adjacent the upper end thereof and which is secured to the underside of the conveyor assembly 32 at a position for receiving media from the outlet end 38 thereof. The inlet section 82 of the enclosure 80 comprises generally rectangularly arranged, vertical sides 84, 86, 88 and 90, the lower ends of which are communicable with a first outlet section 92 of the mechanism 44 that is in the form of a generally rectangularly cross section, angularly arranged or inclined media chute or ramp comprising side sections 94, 96, 98 and 100. The side sections 94–100 terminate at their lower ends at a discharge or distal end portion 102 which is disposed directly above the open upper side of the finishing tub 14 and functions to communicate finishing media thereinto.

The enclosure 80 includes a second outlet section, generally designated by the numeral 104, which comprises downwardly converging side sections 106, 108, 110 and 112 which terminate at their lower ends in a discharge or distal end portion 114 that is located directly above the inlet opening 74 of the housing 50 for the media conveyor assembly 46 and is intended to supply finishing media M to the conveyor belt 72 thereof for subsequent transfer of such media to the outlet opening 76. Disposed within the inlet section 82 of the housing 80 is a generally flat or planar media deflecting plate or gate, generally designated by the numeral 122. The gate 122 is fixedly secured to an elongated pivot shaft 124 that is pivotably mounted within the enclosure 80 and has an elongated downwardly extending control arm 126 secured to one end thereof. The arm 126 is adapted to be pivotable between the solid and phantom line positions in FIG. 4 in order to effect a corresponding pivotal movement of the gate 122. As illustrated, the control arm 126 includes an upper end portion 128 which is affixed to the shaft 124, an intermediate portion 130 and a lower portion 132 defining a "pointer" 134 which is cooperable with an arcuate indicator plate 136 having indicia for providing a visual indication of the position of the arm 126 and hence the gate 122, as best seen in FIG. 6. The intermediate portion 130 of the arm 126 is provided with a control element 138 formed with a transversely extending threaded bore 140 within which an adjustable screw member 142 is threadably received. The screw member 142 comprises an elongated shaft 144 having externally formed threads which cooperate with the threads on the interior of the bore 140, as shown in FIG. 6, with one end of the member 42 being supported for rotational movement about the longitudinal axis of the member 142 by means of a suitable journal supported device, generally designated by the numeral 146. The end of the member 142 opposite the control element 138 is provided with a suitable manually adjustable hand wheel or the like 148 having a handle 150 to facilitate rotating the member 42 and hence advancing the control element 138 along the axis of the shaft 144 in order to effect pivotal movement of the control arm 126 and pivot shaft 124 and hence selective pivotal movement of the gate 122.

Generally speaking, the gate 122 is intended to function in directing or deflecting the media M being conveyed by the conveyor assembly 32 to either the inlet zone 16 of the finishing tub 14, or the secondary media conveyor assembly 46 wherein such media is returned to the outlet zone 18 of the finishing tub 14. More specifically, when it is desired to have a minimum finishing cycle time, all of the media returned via the conveyor assembly 32 should be communicated to the inlet end 16 of the finishing tub 14. Under these circumstances, the gate 122 is positioned in the phantom line position in FIG. 4 wherein such media is directed downwardly via the first outlet section 92 of the housing 80 directly into the interior of the inlet end of the finishing tub 14. Conversely, when it is desired to maximize the length of the finishing cycle, it is desirable to minimize the amount of media which is returned to the inlet end 16 of the finishing tub 14 and hence the deflecting gate 122 is positioned in the solid line position shown in FIG. 4 wherein all of the media which is returned via the conveyor assembly 32 is transferred via the gate 122 into the second outlet section 104 of the housing 80, wherein the media is discharged into the interior of the secondary conveyor assembly 46 and is communicated by means of the conveyor belt 72 therewithin to a position adjacent the outlet zone 18 of the finishing tub 14. As will be appreciated by those skilled in the art, any desired finishing cycle time between the maximum and minimum may be achieved by properly positioning or adjusting the gate 122 which results in proportioning or ratioing the media between the first and second outlet sections 92, 104 and hence between the inlet and outlet zones 16, 18, respectively, of the finishing tub 14. It is contemplated that the cycle time for typical workpieces being communicated through the finishing tub 14 may be varied in the above manner from a minimum cycle time of only several minutes to a maximum cycle time of in the order of one hour, depending on positioning of the gate 122 and hence the distribution of the media being returned via the conveyor assembly 32 to the finishing tub 14. It will be appreciated, of course, that the cycle time will vary with the type of workpiece being processed, the particular type of media, and the size and location of the discharge chute located at the outlet end 18 of the finishing tub 14, i.e., when the discharge chute is relatively elevated, the cycle time will be proportionately greater due to the difficulty of the workpieces and finishing media being able to traverse the length of the finishing tub 14 and pass over the chute into the separating assembly 20.

It will be seen from the foregoing that the present invention provides a novel means wherein the finishing cycle time for a feed-through type vibratory finishing machine may be varied significantly through merely manipulating or proportioning the media which is being supplied to the machine between two different locations or zones within the finishing tub, whereby to assure that the desired finishing time is achieved and that no objectionable workpiece congestion or accumulation occurs at the discharge end of the finishing tub, as would be the case if the finishing tub were merely raised or lowered for controlling cycle time. It will be seen that the ratioing or proportioning device of the present invention is of a relatively simple design and will therefore be economical to manufacture and maintain and will have a long and effective operational life.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

We claim:

1. In combination with a vibratory finishing machine having a finishing chamber provided with an inlet portion and an outlet portion and a finishing media supply means, said supply means comprising a return conveyor having inlet and outlet portions for returning media from said outlet portion of said finishing chamber to said inlet portion thereof, means for receiving media from said supply means and for selectively proportioning the same to said inlet and outlet portions of said finishing chamber, and said last mentioned means including (a) a secondary conveyor means having inlet and outlet portions for delivering media from said outlet portion of said return conveyor means toward a position adjacent said outlet portion of said finishing chamber, and (b) means for receiving media from said return conveyor, and first and second delivery means for deliverying media to said inlet portion of said finishing chamber and to said inlet portion of said secondary conveyor, respectively.

2. The invention as set forth in claim 1 which includes gate means and means for manually selectively positioning said gate means to vary the amount of finishing media supplied to said first and second delivery means.

3. The invention as set forth in claim 2 wherein said gate means comprises a movable plate-like gate member, a control arm for selectively pivoting said gate member and manually operated shaft means for selectively pivoting said control arm and said gate member.

4. The invention as set forth in claim 3 wherein said manually rotated shaft means is threaded and has a manually rotatable wheel thereon.

5. The invention as set forth in claim 1 wherein said finishing chamber is at a first level, said return conveyor has its inlet end at said first level and its outlet end at an elevated level, and wherein said secondary conveyor has its inlet end at a position intermediate said first level and said elevated level.

* * * * *